US005154157A

United States Patent [19]

Goepfert

[11] Patent Number: 5,154,157

[45] Date of Patent: Oct. 13, 1992

[54] COMPRESSED AIR WEAPON

[75] Inventor: Peter Goepfert, Bonstetten, Switzerland

[73] Assignee: Sony Corporation, Tokyo, Japan

[21] Appl. No.: 423,948

[22] Filed: Oct. 19, 1989

[51] Int. Cl.[5] ..... F41B 11/00

[52] U.S. Cl. ..... 124/69; 124/70; 124/76

[58] Field of Search ..... 124/40, 56, 63, 64, 124/65, 69, 70, 71, 73, 76, 75, 67

[56] References Cited

U.S. PATENT DOCUMENTS

| | | | |
|---|---|---|---|
| 1,292,665 | 1/1919 | Udesen | 124/70 X |
| 1,825,489 | 9/1931 | Tostenson | 124/76 X |
| 2,828,579 | 4/1958 | Schwerbel et al. | 124/64 X |
| 3,308,803 | 3/1967 | Walther | 124/76 X |
| 3,320,941 | 5/1967 | Houghton | 124/40 X |
| 3,763,843 | 10/1973 | Fisher et al. | 124/69 |

FOREIGN PATENT DOCUMENTS

| | | | |
|---|---|---|---|
| 2414115 | 10/1975 | Fed. Rep. of Germany | 124/76 |
| 711542 | 7/1954 | United Kingdom | 124/69 |

*Primary Examiner*—Peter M. Cuomo
*Assistant Examiner*—Jeffrey L. Thompson
*Attorney, Agent, or Firm*—Lewis H. Eslinger

[57] ABSTRACT

A compressed air gun comprises a plastic casing, in which a low-pressure cylinder is arranged beneath the gun barrel and a high-pressure cylinder is arranged behind the barrel, with a pressure release system between the cylinders. Two pistons are contained within the respective cylinders and are connected to a cocking lever each by a separate hinge rod. A series of catches and releases requires all operative steps to be completed in the correct sequence before firing to prevent overloading of the air pressure system and also to prevent accidents.

23 Claims, 4 Drawing Sheets

COMPRESSED AIR WEAPON

BACKGROUND OF THE INVENTION

1. Field of the Invention

This invention relates generally to a so-called air gun and, more particularly, to a compressed air weapon having two pressure cylinders and a trigger actuated valve.

2. Description of the Background

Various configurations and styles of compressed air guns are known today. One example of such a compressed air weapon is shown in German patent publication DE-OS 1,553,929 that shows a compressed air weapon having a barrel, a first compression piston arranged within a relatively large, low-pressure cylinder, a second compression piston arranged within a smaller, high-pressure cylinder, a cocking lever, and a valve housing having a pressure release that is activated by a trigger. In this known air rifle, the piston rod of the low-pressure cylinder forms the high-pressure cylinder, so that both cylinders are arranged behind the barrel co-axial with the axis of the barrel. The pressure release is acted upon by the pressure of the high-pressure cylinder in the opening direction and is held by a trigger rod in the closed position. A tapered sealing element seals in a tapered seat of the valve housing, which is crossed horizontally by a passage between the high-pressure cylinder volume and the bore of the barrel. The dead volume of the high-pressure cylinder is relatively large and does not contribute much toward powering the shot, because the high pressure passage must traverse the entire high-pressure cylinder piston rod. The arrangement of the two cylinders behind the barrel also requires a large overall length for the gun, and the valve member is subject to high stress transversally to its axis and, therefore, undergoes a large amount of friction. Moreover, the sealing element wears out rapidly, and during its movement the cocking lever is not locked against a recoil, making overall operation dangerous.

Another compressed air gun is known from German patent publication DE-OS 2,330,535, and this rifle includes only a single compression stage, which exercises correspondingly high stresses on the component parts, when the overall projectile force is the same as a two-stage compression system. In that air rifle, the cylinder is arranged under the barrel, and the pressure release is opened against spring tension.

An air gun having a spring-loaded piston is described in German patent publication DE-OS 2,631,256. In this air gun, the cocking lever has a recoil catch with a swivelling catch element that engages in the thread teeth of a screw. When the spring is extended, the cocking lever, therefore, cannot accidentally overshoot to the front; rather, it must be pulled to its back stop. An air gun also having a recoil catch is described in German patent publication DE-OS 3,611,731.

Another compressed air gun of the two-piston variety described above is known from German patent publication DE-OS 2,263,271. In that air gun, the piston of the low-pressure cylinder also constitutes the high-pressure cylinder, with the high-pressure piston being anchored to the block. The pressure release is a seat valve, which is opened by a trigger rod system against the pressure in the high-pressure chamber and against the force of a locking spring. The compressed air gun described in Swiss patent CH-PS 458 127 is constructed in a similar manner.

SUMMARY OF THE INVENTION

Accordingly, it is an object of the present invention to provide a compressed air weapon that can eliminate the above-noted defects inherent in the prior art.

It is another object of the invention to provide a compressed air weapon in which the projectile force is as constant as possible, that can be manufactured at low cost, and that can be operated safely.

According to a first aspect of the present invention, these objectives are achieved by providing at least the low-pressure cylinder and the valve housing as an integral plastic body in which the barrel is fastened.

According to a second aspect of the invention, these objectives are achieved by connecting the cocking lever to both pistons in the respective low-pressure and high-pressure cylinders each through a single, respective hinge rod.

According to a third aspect, the objectives of the invention are achieved by equipping the weapon with a locking mechanism, which permits an exclusive set sequence of movements for both the loading process and the firing of the shot, whereby each movement required for the loading process is locked mechanically until the preceding movement within the sequence is completed.

The above and other objects, features, and advantages of the present invention will become apparent from the following detailed description of illustrative embodiments thereof to be read in conjunction with the accompanying drawings, in which like reference numerals represent the same or similar elements.

DETAILED DESCRIPTION OF PREFERRED EMBODIMENT

Figure 1:
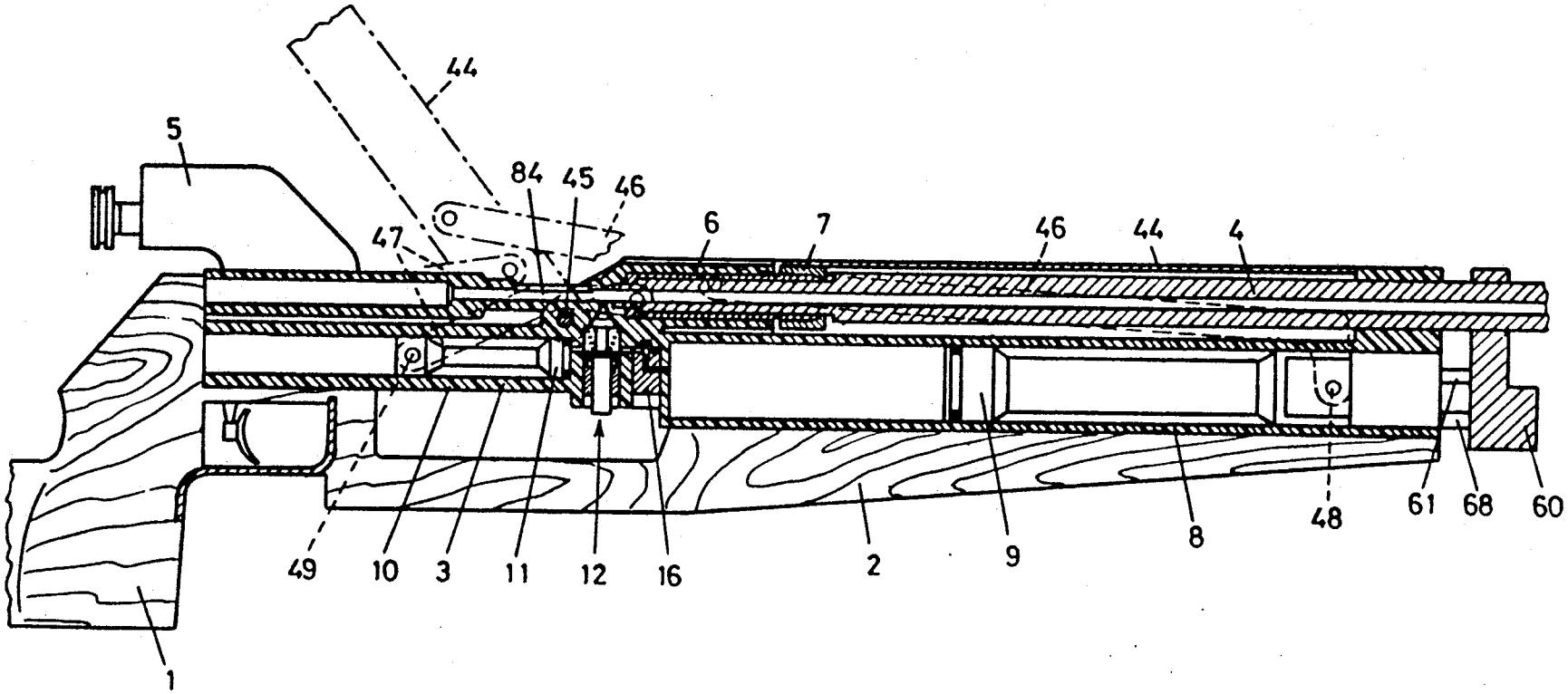
FIG. 1 is a longitudinal cross section through a compressed air rifle constructed according to an embodiment of the present invention.
Figure 2:
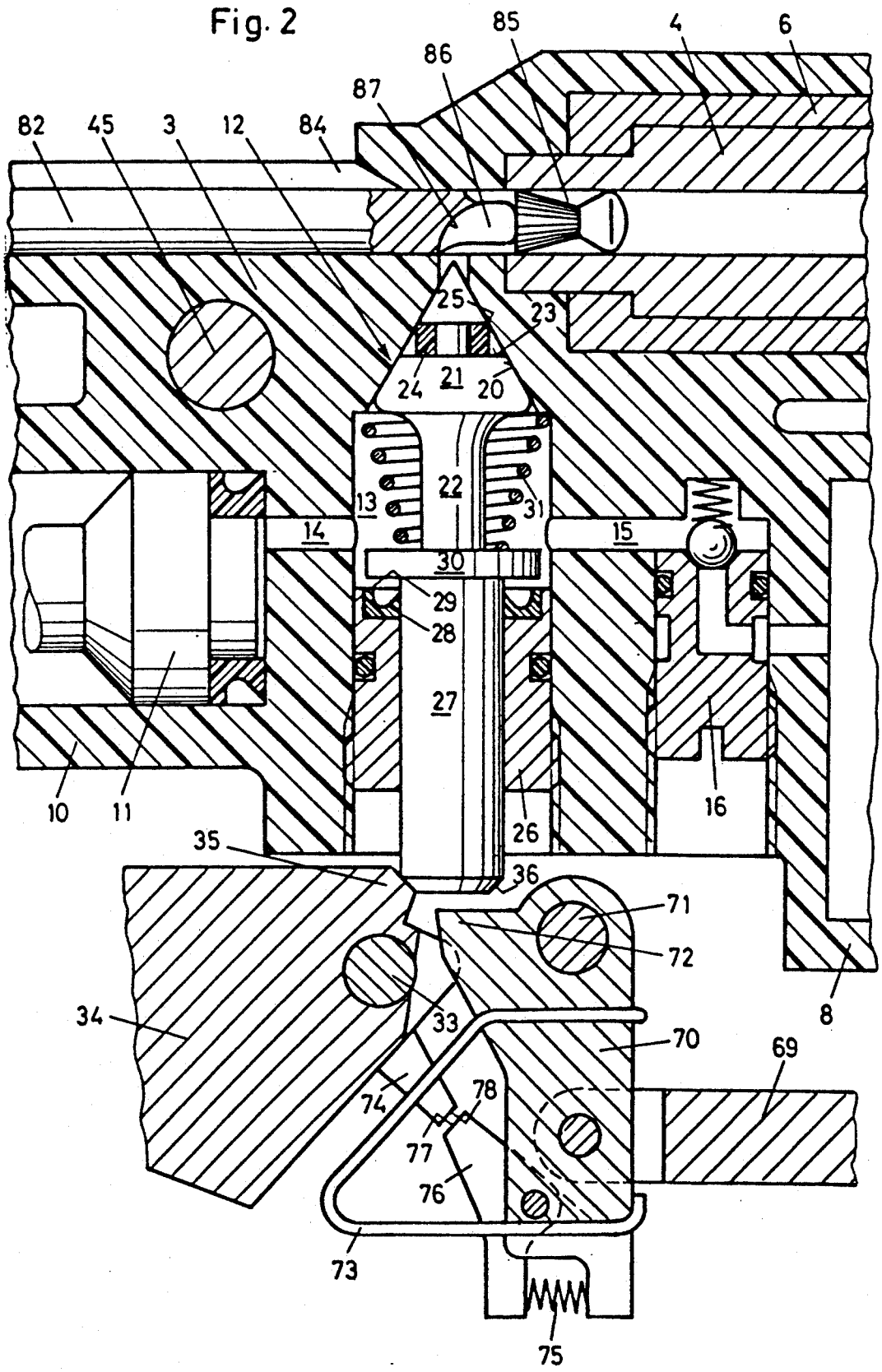
FIG. 2 is a portion of the longitudinal cross section according to FIG. 1 on an enlarged scale.

The compressed air gun in FIG. 1 comprises a wooden stock 1 having a forestock piece 2 to which is fastened an integral plastic casing 3. The casing 3 supports a barrel 4 as well as a sight 5. The barrel 4 is set within a metal sleeve 6, which is cast into the casing 3, and is tightly clamped by a sleeve nut 7 Barrel 4, thus, is firmly anchored to plastic casing 3, yet is exchangeable. Beneath the back end of barrel 4, in the casing 3, a low-pressure cylinder 8 is formed parallel to the axis of barrel 4 and contains a piston 9, which is longitudinally movable Behind low-pressure cylinder 8 a smaller, high-pressure cylinder 10 is arranged parallel to low-pressure cylinder 8, but slightly offset upwards toward the top of the gun. Within high-pressure cylinder 10 another piston 11 is longitudinally movable. Between the two cylinders, 8 and 10, is arranged a pressure release unit 12 including a high-pressure chamber 13 situated within plastic casing 3, as shown in FIG. 2. Chamber 13 is directly connected by a connecting channel or passage 14 to high-pressure cylinder 10 and by another channel or passage 15 to low-pressure cylinder 8. A check valve 16 having low opening pressure is arranged in passage 15 very close to low-pressure cylinder 8. This arrangement keeps the dead volume at a low level.

Pressure release unit 12 shown in detail in FIG. 2 comprises a tapered seat 20 that is formed within casing 3 and in which a cone 21 of the valve member 22 is seated. Cone 21 has a circumferential groove 23 in which an elastomeric gasket 24 is seated. Elastomeric gasket 24 is formed as a ring that seals with an edge 25 against seat 20. This enables an exact definition of the area of the sealing cross section. At the bottom, valve member 22 comprises a longitudinally movable guide shaft 27 arranged in a bushing 26. Shaft 27 is in sealing contact with bushing 26 by means of a lip seal 28 having an exterior, cylindrical stop 29. When valve 12 is opened, a flange 30 of valve member 22 strikes stop 29 so that valve member 22 is cushioned and the weapon is subjected only to weak vibrations. Moreover, the force exerted on gasket 28, 29 by flange 30 pushes the gasket more strongly against shaft 27; this means that higher friction is caused which, in turn, at least softens possible recoiling of valve member 22.

The diameter of shaft 27 is larger than the diameter of seal edge 25 of elastomeric gasket 24, so that valve member 22 is loaded in the direction of the opening by means of the pressure in chamber 13. Immediately upon being raised from seal edge 25, the pressure acts on the entire cross section of shaft 27. A spring 31 supports the opening force, which is created by the difference in diameters between the seal edge 25 and the shaft 27 in connection with the pressure in the chamber 13. Due to the pressure release that opens via auto pressure, only very small forces are required in the trigger system which, therefore, can be constructed to be extremely light. During the shot development time, the moving masses thus remain minimal. In an alternative embodiment, the opening force can be provided using only spring 31, whereby in such embodiment the diameter of seal edge 25 is equal to the diameter of shaft 27.

FIG. 2 shows the air rifle prior to the firing of a shot, and in which valve member 22 is supported by a valve lever 34 that swivels around a bolt 33 that is anchored to casing 3. A nose 35 of valve lever 34 supports a chamfered lower end 36 of shaft 27. In the embodiment of FIG. 2, a line perpendicular to the supporting area of nose 35 runs on the left side of the axis of bolt 33, so that lever 34 is loaded in the counter-clockwise direction by the opening force of valve member 22.

Figure 3:
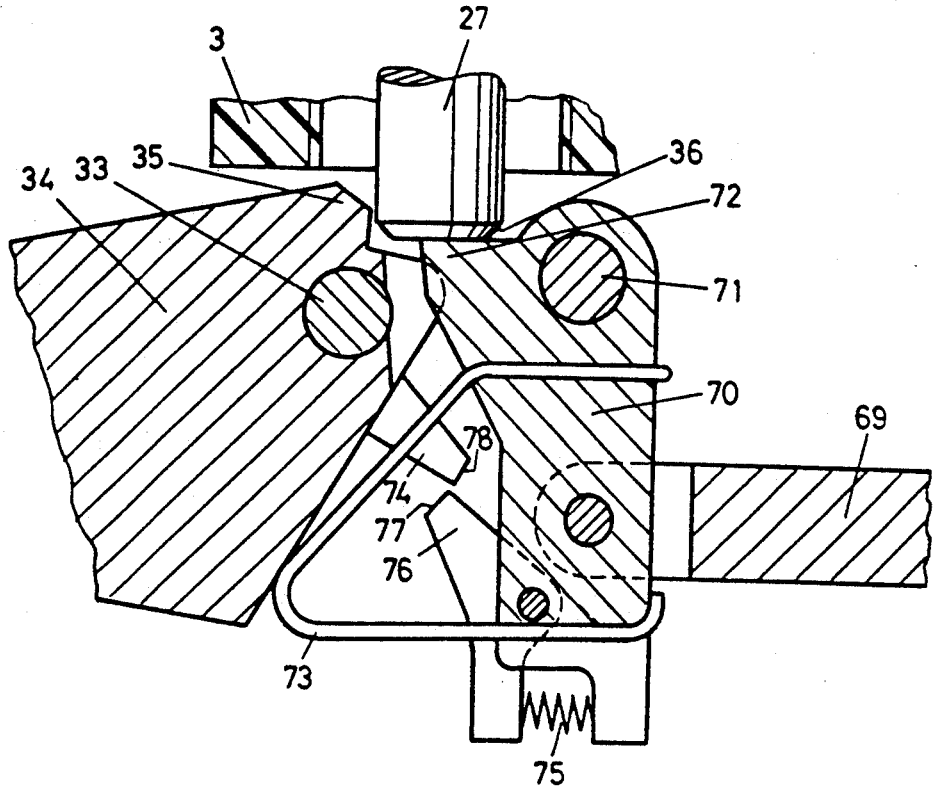
FIG. 3 is a part of the portion according to FIG. 2 in a different operating position.
Figure 5:
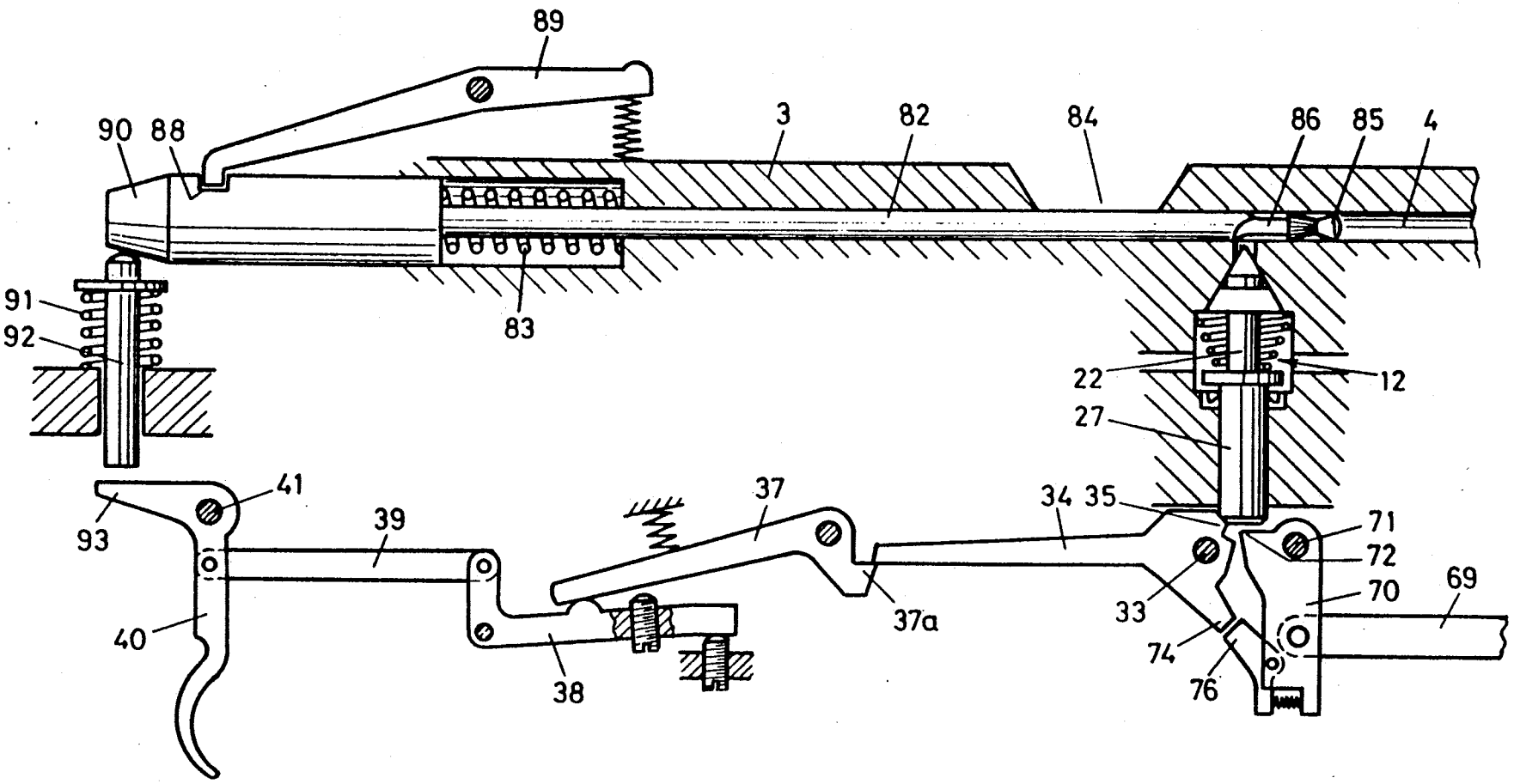
FIG. 5 is a schematic representation of the trigger mechanism of the air rifle of FIG. 1.

Valve lever 34, in the position shown in FIG. 2, is held in place by a nose 37*a* of a pivotally mounted, spring-loaded trigger lever 37, as shown in FIG. 5. Trigger lever 37 is swivelled by an operating lever 38 that is connected to a trigger 40 by a coupling rod 39. Trigger 40 pivots around another bolt 41 that is anchored to casing 3. When trigger 40 is pulled, trigger lever 37 pivots in the clockwise direction and with its nose 37*a* releases valve lever 34. Valve lever 34 then pivots in the counter-clockwise direction, so that nose 35 releases valve member 22 and opens it under pressure in the chamber 13. This state is shown in FIG. 3.

This operation according the present invention requires acceleration of only very small masses so that the reaction time that elapses between the pulling of trigger 40 beyond its pressure point until the complete opening of pressure release unit 12 is very short. Due to tapered valve seat 20 in connection with cone 21 of pressure release unit 12, a low-loss acceleration of the outflowing compressed air is achieved through the constant narrowing of the discharge cross section. Because of the above-described construction, the volume between the upper end of cone 21 and the back end of barrel 4 can be minimized. Therefore, only a very small pre-expansion occurs until the onset of the actual shot development. Thus, the stored potential energy is converted almost entirely into kinetic energy of the projectile.

In regard to the cocking action, a cocking lever 44 which in the normal position is arranged parallel to barrel 4 swivels around a bolt 45 that is set into casing 3, as shown in FIG. 1. Lever 44 is connected to both pistons 9 and 11 by joint rods 46 and 47, respectively, shown in dashed lines in FIG. 1. For this purpose, at their ends that face away from pressure release unit 12, pistons 9, 11 are crossed by one pin 48, 49, respectively, which extend into cylinders 8, 10 through elongated slots and on whose ends rods 46, 47 are respectively articulated. On cocking lever 44, rod 46 of low-pressure piston 9 is articulated to bolt 45 with a larger radius than is rod 47 of high-pressure piston 11. Thus, piston 9 has a larger stroke than piston 11. Such stroke ratio is found to be suitable when it exceeds two-to-one, and when the piston displacement ratio of the low-pressure cylinder to the high-pressure cylinder is between four-to-one and twenty-to-one. The hinge or pivot geometry is selected in such a manner that when cocking lever 44 is fully swung out, the position that is indicated by the broken line in FIG. 1, the hinge triangle of low-pressure piston 9 almost reaches the dead point, whereas during the movement into the normal position of cocking lever 44 the hinge triangle of high-pressure piston 11 just exceeds the dead point. Because of this, on the one hand, the force that must be exercised on cocking lever 44 toward the end of the compression cycle remains restricted and, on the other hand, cocking lever 44 is retained in the normal position due to the pressure that accumulates at high-pressure piston 11 in the cocked position.

Figure 4:
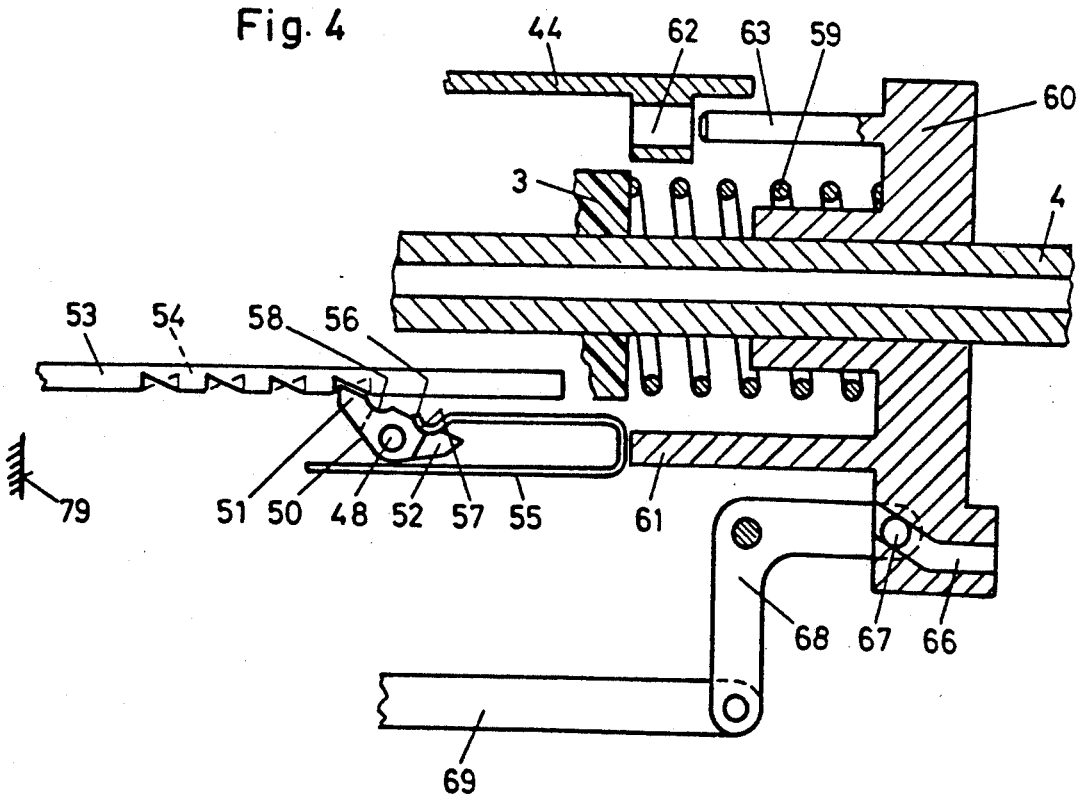
FIG. 4 is a schematic representation of an actuating member of the air rifle of FIG. 1.

In order to prevent cocking lever 44 from recoiling during the cocking process, a ratchet system is provided that is shown in FIG. 4. In such system a pawl is formed as a swivelling notch member 50 that includes two noses 51, 52 pivotably mounted on pin 48 outside low-pressure cylinder 8 but inside of rod 46. The two noses 51, 52 of pawl 50 are offset against each other in the direction of the axis of the pin 48 and act in concert with respective ones of two adjacent toothed racks 53, 54 that are fastened within casing 3 and have saw-shaped teeth. Pawl 50 is loaded by a fastening spring 55 that is longitudinally movable within casing 3. One free end of spring 55 is bent with a small radius so that it engages in one of the two notch recesses 57, 58 formed in an upper surface of pawl 50. In the described normal position, end 56 rests in recess 57 and presses nose 51 into engagement with toothed rack 53 so that piston 9 is secured against any backward or rearward movement. Prior to operating cocking lever 44, an operating knob 60, shown in FIG. 4, which is movable along barrel 4 and is front-loaded by a spring 59, is pulled back. This causes a protruding element or shoulder 61 of knob 60 to push fastening spring 55 backward so that bent end 56 moves into the other notch recess 58, thereby causing nose 52 to engage the toothed rack 54 and release lever 44, thus enabling the pulling movement. As long as knob 60 remains in the pulled position, however, a bolt 63, which is fastened to the knob 60, in a bore 62 of the cocking lever 44, and restrains it from movement. Cocking lever 44 becomes operable only after knob 60 has been released.

When knob 60 is pulled back a swivel arm 68 is pivotted around a pin 67 that extends into a guide groove 66 formed in knob 60. A plunger arm 69 is articulated at one end on the second arm of said swivel arm 68, and the back end of plunger arm 69 is articulated on a lever 70, as shown in FIG. 3. Lever 70 is pivotally mounted on a bolt 71 that is anchored in casing 3. A nose 72 of lever 70 extends under the chamfered end of shaft 27 of valve member 22. When plunger arm 69 is operated, lever 70 is pivotted and nose 72 pushes valve member 22 into the closed position. Simultaneously, a spring clip 73, which is fastened to lever 70, swivels valve lever 34 upward (clockwise) so that it catches into position with its nose 35 beneath chamfer 36 and on nose 37*a* of the trigger lever 37. This causes an extension 74 of valve lever 34 to pivot from the position shown in FIG. 3 into the position shown in FIG. 2. As soon as knob 60 is released, plunger arm 69 moves forward and causes lever 70 to pivot into the normal position. This causes a swivelling catch member 76, which is situated on the cocking lever 70 and which is pre-loaded against a stop by a spring 75, to run up to extension 74, to pass it, and finally to come to rest with its frontal area 77 opposite the frontal area 78 of extension 74. This secures knob 60 against renewed operation prior to the firing of the next shot.

After knob 60 has been pulled and released, cocking lever 44 can be operated so that low-pressure piston 9 compresses the air in cylinder 8 and pushes it through passages 14, 15, and through check valve 16 into high-pressure cylinder 10 in front of the backward moving piston 11. When the cocking lever 44 is released, due to the ratchet action provided by pawl 50 and racks 53, 54 it recoils at the most a few millimeters until the next engagement of the pawl in a notch. In addition, the air that has already flown into cylinder 10 attenuates recoil of the cocking lever 44. When the cocking lever 44 is pivotted backward completely, fastening spring 55 strikes a rear stop 79, which is anchored to casing 3, and is pushed forward relative to pawl 50 until bent end 56 engages in notch recess 57, thus allowing nose 51 to engage in toothed rack 53. Now, cocking lever 44 is secured against recoiling during its forward movement. During this movement, the air in high-pressure cylinder 10 is compressed to the delivery pressure. Further cocking of cocking lever 44 is impossible prior to the firing of the shot, because pawl 50 cannot be switched by means of knob 60, which is locked by the catch member 76 that would abut member 74. Consequently, the gun is protected against a projectile energy that is too high and against overloading.

During the operation of cocking lever 44, a loading slide 82, shown in FIGS. 2 and 5, is opened automatically. Loading slide 82 is slid manually into the closed position against the force of a spring 83, whereby pellet 85, which has been placed into a loading opening 84 is pushed by a forked front end 86 of loading slide 82 into the back end of barrel 4. An arcuately shaped slit 87 is milled at the fork-shaped front end 86, in order to minimize the air-flow losses. At the back of loading slide 82 is formed a notched recess 88, in which in the closed position one arm of a spring-loaded, two-armed notch lever 89 engages. The other arm of the lever 89 is depressed when cocking lever 44 is swivelled back completely, so that loading slide 82 is released and is slid backward by spring 83. This causes a conical or tapered extension 90 to move down a pin 92, which is upward-loaded by a spring 91. In the bottom position, the lower end of pin 92 has only a small clearance relative to an arm 93 of trigger 40, so that trigger 40 can not be operated until loading slide 82 is moved manually, and therefore consciously, into the closed position.

The plastic casing 3 allows for movements of pistons 9, 11 that are low in friction and does not require lubrication, so that relative to known air rifles the energy expended for operation is low. Extremely short and very regular valve opening times are achieved because the pressure release is opened through gas pressure. The advantageous inflow-technique arrangements on valve cone 21 and at the end of loading slide 86 help to keep flow losses low. The volume loss and therefore the pre-expansion are kept to a minimum due to the above-described construction arrangement of the pressure release and of the loading slide toward the end of the barrel. All these measures combine to increase the efficiency level of the conversion into kinetic shot energy of the potential energy stored in the compressed air. Relative to known air rifles, the pressure required in chamber 13 for a given kinetic shot energy can thereby be lowered considerably. A low reservoir pressure is a precondition for weaker forces at the cocking lever The arrangement of the kinematics through which this pressure is created is another precondition, because both pistons 9 and 11 are connected to cocking lever 44 through one separate, respective hinge rod 46, 47, the crank-kinematics for both pistons can be optimized and, above all, attuned to one another in such a manner that in spite of the hyperbolic characteristics of the pressure-stroke correlation of the almost isothermal compression, no essential torque peaks are required at cocking lever 44. The maximum torque required for the cocking process at cocking lever 44 is so low that the lever can be constructed to be relatively short. In a prototype intended for a maximum shot energy of 7.5 Joule, the maximum required force on a 300 mm long cocking lever was below 40 Newtons. This low effort in terms of muscle strength and the advantageous position of the fulcrum of the cocking lever allow the shooter to cock the gun in the shooting position. Because the pressure release opens precisely and quickly, stops softly and thereby moves low masses, and because the plastic casing cushions the vibrations, the shot delivery is low in vibration and almost all the energy is transferred to the projectile. This allows the weapon to be highly precise. Due to the built-in catches and guards, the air gun according to the present invention is absolutely safe to operate. Because the compressed air spaces are almost free of any metal, the pressure system is corrosion-proof and requires low maintenance. Due to the small number of component parts, both the production costs and the assembly time are kept at a low level. The aforementioned arrangement is suited not only for shoulder arms but also for compressed air pistols.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. A compressed air weapon comprising: a barrel, a first compression piston that is arranged in a low-pressure cylinder, a second compression piston that is arranged in a high-pressure cylinder that is smaller than the low-pressure cylinder, a pressure release valve arranged in a valve housing and operated via a trigger, and a cocking lever, wherein at least the low-pressure cylinder, the high-pressure cylinder, and the valve housing are formed as an integral plastic element to which the barrel is fastened.

2. A weapon according to claim 1, wherein the two cylinders are arranged substantially parallel to and beneath the axis of the barrel and are axially spaced from each other, wherein the valve housing is arranged between the two cylinders, wherein the high-pressure cylinder is connected by a direct, free, first passage to a chamber of the pressure release valve, and wherein a check valve is arranged within a second passage connecting the low-pressure cylinder with the chamber.

3. A weapon according to claim 1, wherein a notched rod comprising a plurality of notches is arranged substantially parallel to the low-pressure cylinder, wherein one of the pistons is connected to a pawl element having two notch noses, each of which acts in concert with the notches of the notched rod, wherein the pawl element is shifted by a fastening means movable in two directions between first and second positions, and wherein the fastening means is automatically moved from the first to the second position when the cocking lever is swivelled out completely and is moved by a manually operated element from the second into the first position when the cocking lever is in a normal position.

4. A weapon according to claim 1, wherein the trigger acts in concert with a locking member, which in turn acts in concert with a loading slide in such a manner that the trigger is locked when the loading slide is open.

5. A compressed air weapon comprising: a barrel, a first compression piston that is arranged in a low-pressure cylinder, a second compression piston that is arranged in a high-pressure cylinder that is smaller than the low-pressure cylinder, a pressure release means arranged in a valve housing and operated via a trigger, and a cocking lever, wherein at least the low-pressure cylinder and the valve housing are formed as an integral plastic element to which the barrel is fastened, wherein the valve housing is tapered in the direction of entry into the barrel, wherein a cylindrical shaft of a valve member of the pressure release means is sealed by a sliding gasket against the valve housing, and wherein the diameter of the cylindrical shaft is larger than the diameter of a sealing contact line between the valve member and the valve housing.

6. A compressed air weapon comprising:

a housing;

a barrel fixed at a rear end thereof to the housing and having a barrel axis;

a low-pressure cylinder connected to the housing and arranged underneath the barrel, the longitudinal axis of the low-pressure cylinder being substantially parallel to the barrel axis;

a first piston with a first piston rod slidably received in the low-pressure cylinder;

a high-pressure cylinder connected to the housing axially spaced from and located rearward of the low-pressure cylinder;

a second piston with a second piston rod slidably received in the high-pressure cylinder, the first and second piston rods facing in substantially opposite directions;

a valve chamber arranged in the housing between the high-pressure cylinder and the low-pressure cylinder and containing a valve member;

a first passage connecting the low-pressure cylinder and the valve chamber and containing a nonreturn valve;

a second passage connecting the high-pressure cylinder and the valve chamber;

a cocking lever pivotably supported on a pivot pin fixed to the housing;

a first hinge rod pivotably connected at one end to the cocking lever by a first hinge pin and pivotably connected at the other end to the first piston rod; and a second hinge rod pivotably connected at one end to the cocking lever by a second hinge pin and pivotably connected at the other end to the second piston rod, said second hinge pin being arranged closer to the pivot pin than said first hinge pin.

7. A weapon according to claim 6, wherein the pivot pin of the cocking lever is located adjacent the valve chamber.

8. A weapon according to claim 6, wherein the ratio of the piston displacement of the low-pressure cylinder to the piston displacement of the high-pressure cylinder is between four-to-one and twenty-to-one, and wherein the ratio of the stroke of the first piston to the stroke of the second piston is larger than two-to-one.

9. A weapon according to claim 6, wherein the valve chamber is tapered in the direction of entry into the barrel, wherein a cylindrical shaft of the valve member is sealed by a sliding gasket against the valve chamber, and wherein the diameter of the cylindrical shaft is larger than the diameter of a sealing contact line between the valve member and the valve housing.

10. A weapon according to claim 6, wherein a notched rod comprising a plurality of notches is arranged substantially parallel to the low-pressure cylinder, wherein one of the pistons is connected to a pawl element having two notch noses, each of which acts in concert with the notches of the notched rod, and wherein the pawl element is shifted by a fastening means movable in two directions between first and second positions, the fastening means being automatically moved from the first to the second position when the cocking lever is swivelled out completely and is moved by a manually operated element from the second into the first position when the cocking lever is in a normal position.

11. A weapon according to claim 6, wherein the trigger acts in concert with a locking member, which in turn acts in concert with a loading slide in such a manner that the trigger is locked when the loading slide is open.

12. A weapon according to claim 6, wherein the housing, the low-pressure cylinder and the high pressure cylinder are formed as an integral plastic element.

13. A compressed air weapon comprising: a barrel, a first compression piston that is arranged in a low-pressure cylinder, a second compression piston that is arranged in a high-pressure cylinder smaller than the low-pressure cylinder, pressure release means arranged in a valve housing and operated by a trigger, a cocking lever connected to the first and second pistons, a loading slide for inserting a pellet into the rear end of the barrel, wherein the sequence of loading and firing of the weapon includes the following steps: a) operating the cocking lever, b) closing the loading slide, and c) pulling the trigger, wherein said cocking lever, loading slide, and trigger are each associated with a separate mechanical locking element for blocking respective movement thereof until the movement of the respective preceding member in the loading and firing sequence has been completed.

14. A weapon according to claim 13, wherein the two cylinders are arranged substantially parallel to and beneath the axis of the barrel and are axially spaced from each other, wherein the pressure release means is arranged between the two cylinders and wherein both cylinders are connected by one passage, respectively, to a chamber of the pressure release means, and further comprising a check valve arranged within the passage that is assigned to the low-pressure cylinder.

15. A weapon according to claim 13, wherein the valve housing is tapered in the direction of entry into the barrel, wherein a cylindrical shaft of a valve member of the pressure release means is sealed by a sliding gasket against the valve housing, and wherein the diameter of the cylindrical shaft is larger than the diameter of a sealing contact line between the valve member and the valve housing.

16. A weapon according to claim 15, wherein a further gasket is formed between the valve member and the tapering valve housing in such a manner that the diameter of the sealing contact line is independent of the pressure in the high-pressure cylinder.

17. A weapon according to claim 15, wherein a flange arranged on the cylindrical shaft abuts the sliding gasket, which is anchored to the casing, when the pressure release means is open.

18. A weapon according to claim 13, wherein a notched rod comprising a plurality of notches is arranged substantially parallel to the low-pressure cylinder, wherein one of the pistons is connected to a pawl element having two notch noses, each of which acts in concert with the notches of the notched rod, and wherein the pawl element is shifted by a fastening means movable in two directions between first and second positions, and wherein the fastening means is automatically moved from the first to the second position when the cocking lever is swivelled out completely and is moved by a manually operated element from the second into the first position when the locking lever is in a normal position.

19. A weapon according to claim 18, wherein the manually operated element includes a locking device connected to the trigger mechanism and is arranged to be unlocked only if the trigger has been previously activated.

20. A weapon according to claim 18, wherein the manually operated element is connected to a device to return the pressure release means to a closed position.

21. A weapon according to claim 18, wherein the manually operated element catches the cocking lever whenever it is not in a resting position.

22. A weapon according to claim 13, wherein the trigger acts in concert with a locking member, which in turn acts in concert with the loading slide in such a manner that the trigger is locked when the loading slide is open.

23. A weapon according to claim 22, wherein the loading slide is pre-loaded into one position by a spring and is held in a closed position by a notch element, and wherein the notch element is released when the cocking lever is swivelled out completely.

* * * * *